US005450060A

United States Patent [19]

Parkhurst

[11] Patent Number: 5,450,060

[45] Date of Patent: Sep. 12, 1995

[54] MOTION DETECTION

[76] Inventor: Neil E. Parkhurst, 11 Old Oak Ave., Leino Park, Westminster, Mass. 01473

[21] Appl. No.: 14,218

[22] Filed: Feb. 5, 1993

[51] Int. Cl.[6] ..... G08B 13/183

[52] U.S. Cl. ..... 340/539; 340/286.11; 340/541; 340/573; 340/600

[58] Field of Search ..... 340/539, 531, 286.14, 340/565, 429, 870.09, 870.16, 870.17, 567, 286.13, 995, 541, 573, 286.11, 600

[56] References Cited

U.S. PATENT DOCUMENTS

| | | | |
|---|---|---|---|
| 3,631,434 | 12/1971 | Schwartz | 340/567 |
| 4,110,738 | 8/1978 | Sattin | 340/539 |
| 4,166,273 | 8/1979 | Riley, Jr. et al. | 340/541 |
| 4,570,157 | 2/1986 | Kodaira | 340/567 |
| 4,625,199 | 11/1986 | Pantus | 340/565 |
| 4,831,438 | 5/1989 | Bellman, Jr. et al. | 348/148 |
| 4,890,093 | 12/1989 | Allison et al. | 340/565 |
| 5,113,178 | 5/1992 | Yasuda et al. | 340/995 |
| 5,132,684 | 7/1992 | Pecker et al. | 340/286.13 |

FOREIGN PATENT DOCUMENTS

| | | | |
|---|---|---|---|
| 2235316 | 2/1991 | United Kingdom | 340/567 |

*Primary Examiner*—Jeffery A. Hofsass
*Assistant Examiner*—Daniel J. Wu
*Attorney, Agent, or Firm*—George E. Kersey

[57] ABSTRACT

Apparatus for detecting motion by producing a signal in response to motion, transmitting the produced signal and receiving the transmitted signal which is converted to auditory and electrical outputs, with an ear phone jack connected to an auditory output, an on-off switch connected to the signal converter and a set of indicator lights connected to an electrical output.

16 Claims, 7 Drawing Sheets

MOTION DETECTION

BACKGROUND OF THE INVENTION

This invention relates to motion detection, and more particularly, to the detection of game movement, and that of other hunters in connection with hunting for game.

In conventional hunting practice, a party of hunters goes to a wooded area where game, such as deer, are likely to be found. The members of the party typically separate and go to different areas in search of game. Each hunter searches for the presence of game, and typically responds to perceived movement in the brush or woods. This procedure requires that each hunter remain in a state of continuous alert. During lull periods, when no game is encountered, there is a sense of apprehension, which often causes a premature reaction when the presence of game is finally perceived. The result can be tragic when the motion is that of another hunter.

Accordingly, it is an object of the invention to assist hunters in detecting the presence of game. A related object is to reduce the stress that often accompanies hunting when there is uncertainty when game will be located.

Another object of the invention is provided enhanced safety in hunting. A related object is to reduce the incidence of accidental firing on fellow hunters, or other persons, in the mistaken belief that they may approaching game.

SUMMARY OF THE INVENTION

In accomplishing the foregoing and related objects, the invention provides a system with one or more sensors that detect motion within a given area, and at least one remote receiver that notifies a hunter or outdoorsman that motion has been detected.

In accordance with one aspect of the invention, each sensor can use passive technology, such as that provided by infrared sensing, to detect motion within a limited area. Each sensor desirably is portable, electrically operated and mountable in a variety of ways. Illustrative mountings include strapping to a tree, pole or rock.

Once motion is detected, the sensor triggers a transmitter that, in turn, transmits a signal for a range of approximately 1000'. The transmitted signal may be coded to enable the remote receiver to identify different sensors at different locations. Coding helps to eliminate false alarms that may be caused by two-way radios or other electronic devices. The remote receiver can be a receiver with visual (i.e., LED's) or audible (i.e., beeping tone in an earphone), or both, to alert the hunter outdoorsman that one or more of the sensors has been activated by motion within its range.

DESCRIPTION OF THE DRAWINGS

Other aspects of the invention will become apparent after considering several illustrative embodiments, taken in conjunction with the drawings, in which.

DETAILED DESCRIPTION

Figure 1:
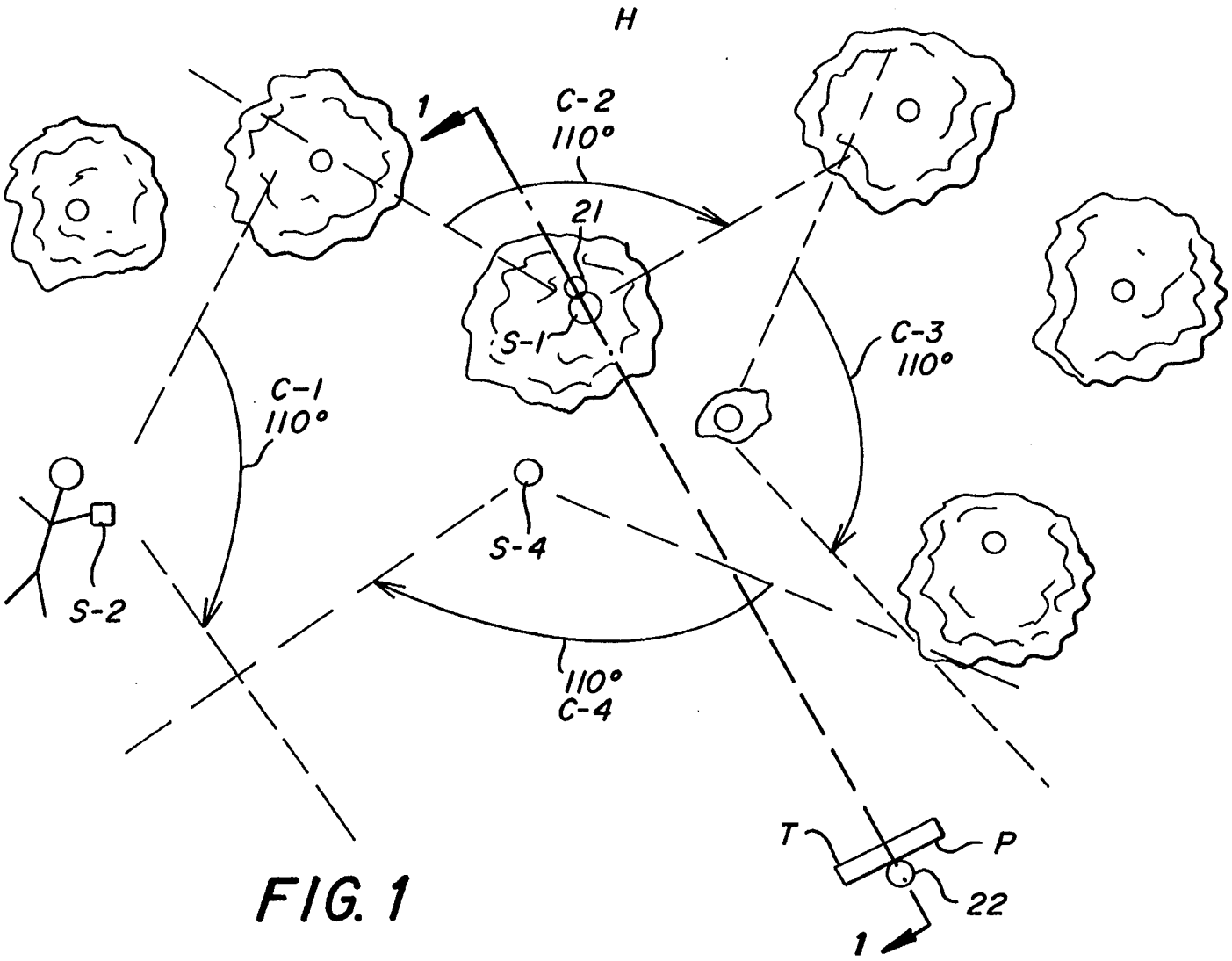
FIG. 1 is a plan view showing a distribution of sensors in accordance with the invention over a hunting area in relation to a stand where a hunter is equipped with a receiver.

With reference to the drawings, FIG. 1 shows a hunting area H where various sensors S-1 through S-4 have been positioned to detect the presence of game or hunters that enter the various sectors C-1 thru C-4 that are sensed by the devices S-1 thru S-4. Each of the sectors is a wedge of radiation, illustratively infra-red. When the radiation is interrupted, for example by a deer or hunter, there is a reflection to the sensor that is interpreted as movement through the wedge. As described in greater detail below, the interruption is converted to an electrical signal that is transmitted to a receiver R at a hunting position P. Typically the receiver R is worn by a hunter at the hunting position P, but it may be in a fixed location at the hunting position.

Figure 2:
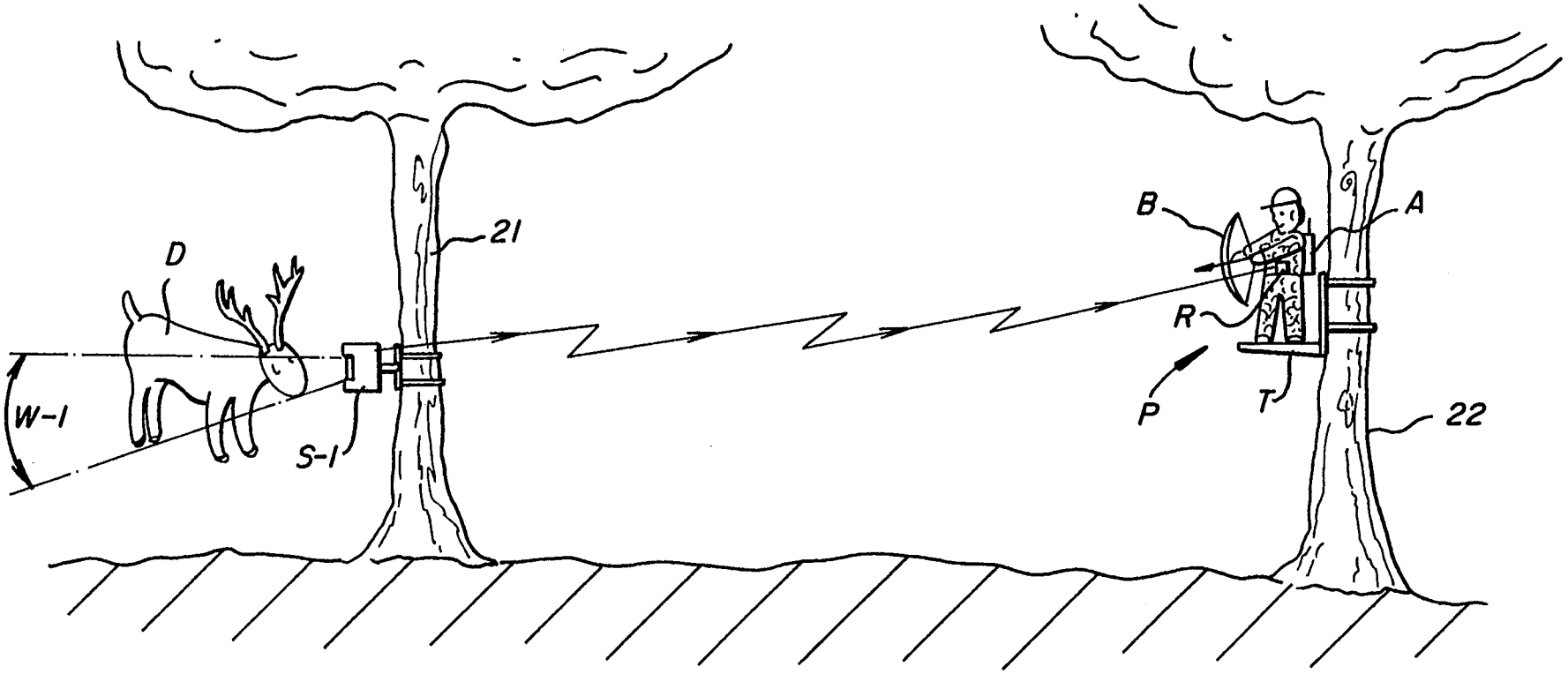
FIG. 2 is a cross-sectional view of FIG. 1 taken along the lines 1—1 showing an illustrative sensor-receiver arrangement in accordance with the invention.

AS shown in FIG. 2, which is a cross-sectional view of FIG. 1 taken along the lines 1—1, an illustrative sensor S-1 is mounted on a tree 21 to produce a wedge of infra-red radiation W-1 that can be interrupted by an object that moves within its field, for example a deer D. In the case of such an interruption, a signal is transmitted from the Sensor S-1 to a receiver R worn by a hunter H at the receiving position, which takes the form of a tree stand T. In FIG. 2, the tree stand T is a platform secured to a tree 22 and the hunter H is equipped with a bow B and a quiver of arrows A. Once signalled by the sensor, the hunter H moves to a heightened state of alertness and readies himself to interpret the movement detected by the sensor S-1.

Figure 3B:
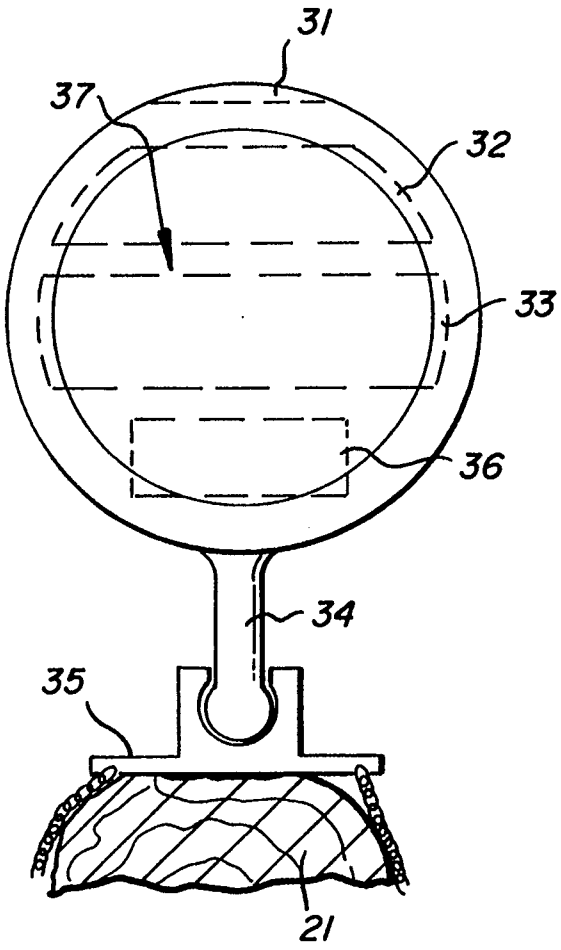
FIG. 3B is a top view of the sensor of FIG. 2.
Figure 3A:
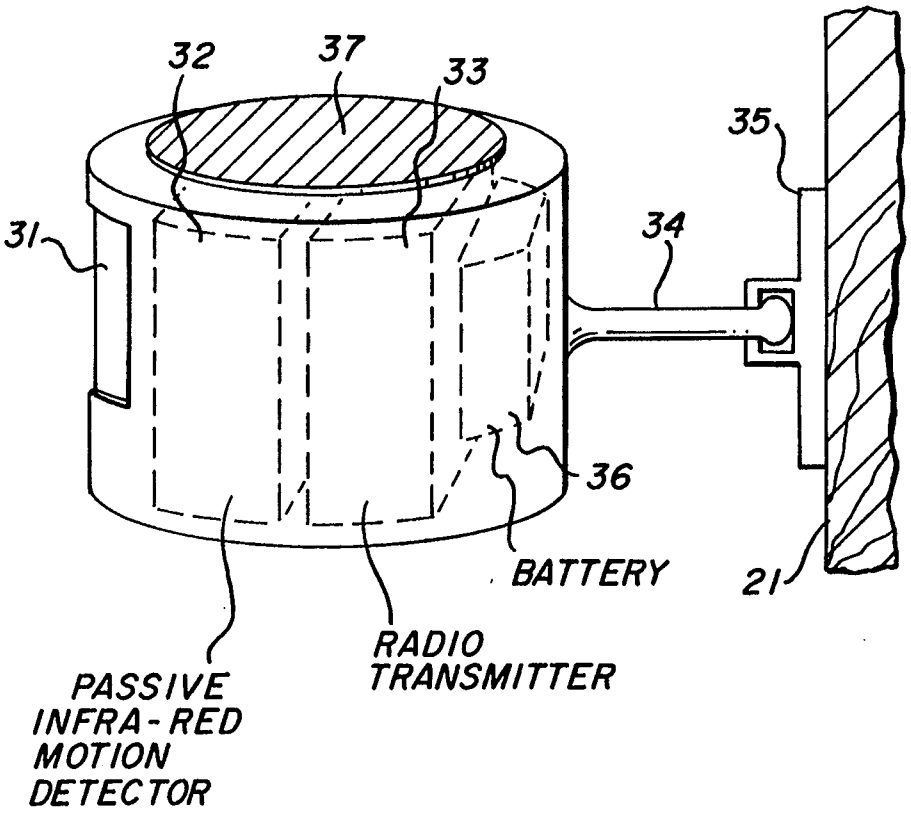
FIG. 3A is a side view of the sensor of FIG. 2.

Structural details of the sensor S-1 are shown in the side view of FIG. 3A. The sensor S-1 has a frontal Fresnel lens 31 which is formed with segments that provide a wide beam of infra-red radiation. Immediately behind the lens 31 is a detector compartment 32 with circuitry that responds to any interruption of the wedge beam W-1. The interruption is transformed into a signal that is radiated by a transmitter 33 within the sensor S-1. A mounting arm 34, by which the sensor S-1 is secured to a mounting bracket 35, serves as an antenna. Both the detector 32 and the transmitter 33 are powered by a battery 36, which can be kept in a state of charge by a solar panel 37 on the outer case of the sensor S-1.

In the top view of the sensor S-1 shown in FIG. 3B, the mounting bracket 35 is secured to the tree 21 by a strap 38 and the sensor S-1 is seen to have a cylindrical housing that accommodates the solar panel 37 as a rectangular array.

Figure 4:
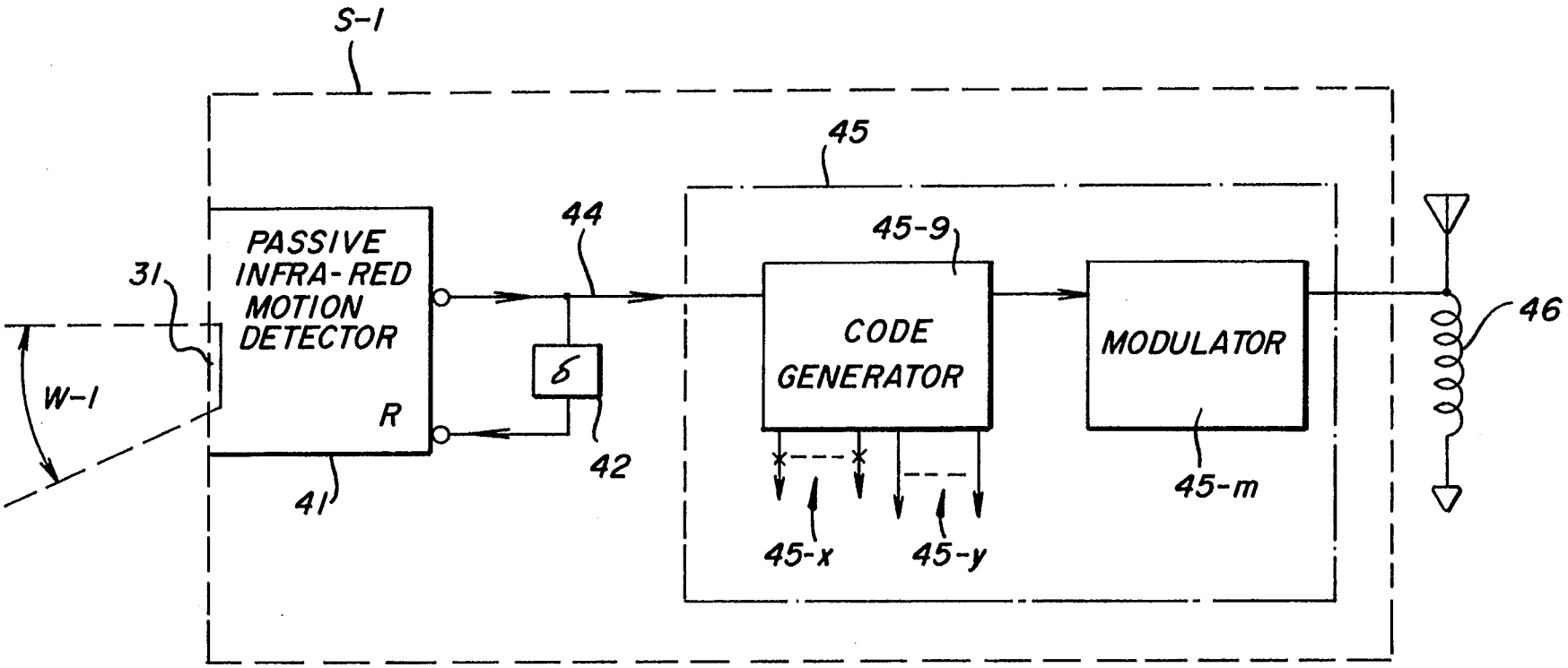
FIG. 4 is a block and schematic diagram of the sensor of FIGS. 3A and 3B.

As indicated in FIG. 4, which is a block and schematic diagram of the sensor S-1 of FIGS. 3A and 3B, there is an output from a sensor module 41 when the beam is interrupted. This output resets the module 41 at a terminal R after a time delay of about 15 seconds produced by a unit. The sensor output on line 44 triggers a code generator 45-g within the transmitter 45. The code is illustratively a set of binary signals that provide a unique designation for the sensor S-1. Where the sensor is a positioned in a grid map of the hunting area, the code may be set using switches 45-x and 45-y to give the grid coordinates where the sensor is located, for example 02-13 where the sensor is positioned at "X" coordinate 02 and "Y" coordinated 13. This translates into, for example, binary code 0010–0111. For the "X" coordinate this is set by the switches 45-x through closure of the third switch, with the remaining switches open. For the "Y" coordinate this is set by the switches 45-y through closure of the second, third and fourth switches, with the first switch open.

The binary code signals are used to modulate a carrier by a modulator 45-m that is connected to a transmitting antenna 46, for example the connecting arm 34 of the mount in FIGS. 3A and 3B.

Figure 5B:
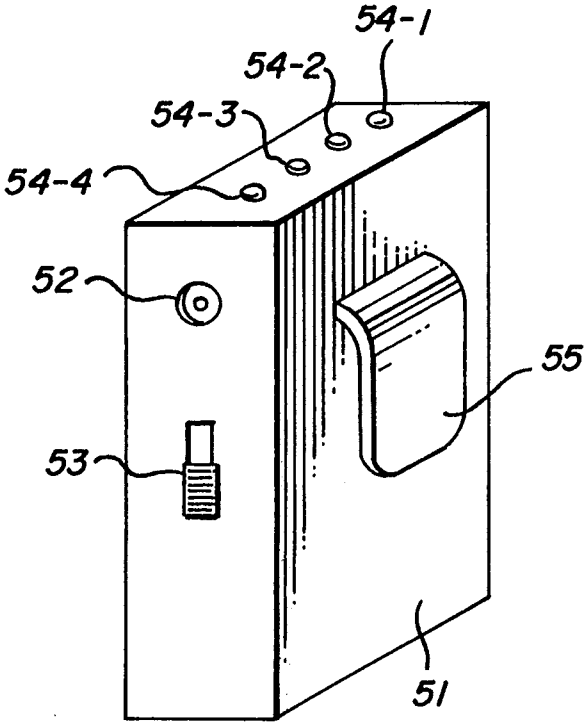
FIG. 5 is a perspective view of the receiver of FIG. 2.
Figure 5A:
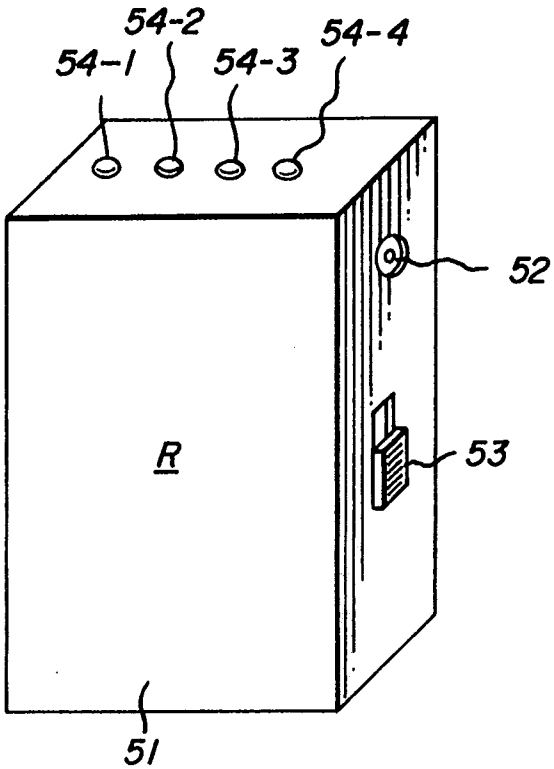

With respect to the perspective view in FIG. 5, the receiver R has a casing 51 with an ear phone jack 52, an on-off switch 53, and a set of indicator lights 54-1 thru 54-4. An optional mounting clip 55 allows the receiver R to be attached to the belt of the hunter H. The ear phone jack 52 allows the hunter to audibly monitor the sensor S-1. He is therefore free to focus his visual attention entirely on the hunting area. In order to allow identification of the specific sensor from which the sound emanates, a different tone is used for each of the sensors S-1 thru S-4. The indicator lights 54-1 thru 54-4 provide a visual identification of the senor or sensors from which motion signals are being transmitted.

Figure 6:
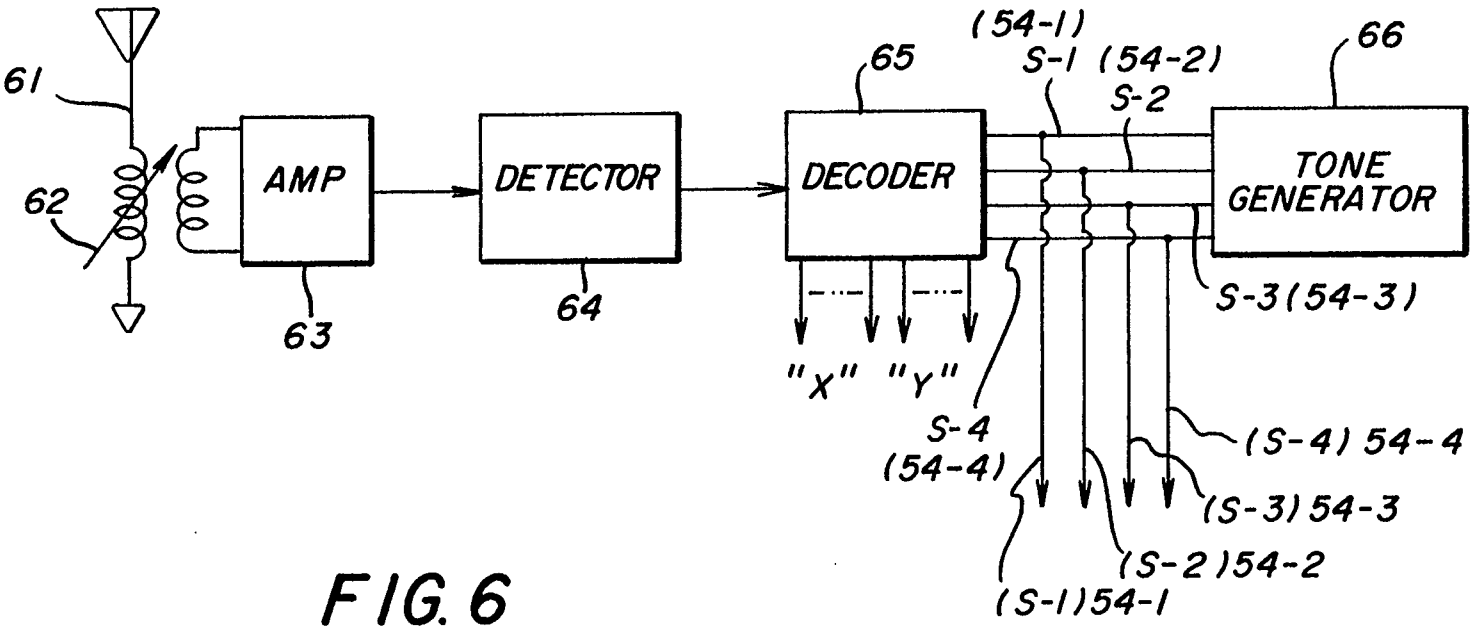
FIG. 6 is a block and schematic diagram of the receiver of FIG. 5.

Details for the receiver R are set forth in FIG. 6, which is a block and schematic diagram 60 of the receiver of FIG. 5. The receiver R has an input antenna 61 tuned to the carrier of the sensors S-1 thru S-4. Adjustments in tuning, where desired, are made by a tuner 62. The received signal is amplified by a first stage 63. This followed by a detector 64 which separates the carrier from the code signals by which the carrier is modulated. The code signals are then decoded at a stage 65 and separate outputs appear on decoder leads. These in turn are applied to a tone generator 66, and to the indicator lights 54-1 thru 54-4. The tone generator produces a different tone for each of the sensors S-1 thru S-4. In one system the tones increase in pitch for according to the numerical designation of the sensor position.

Figure 7:
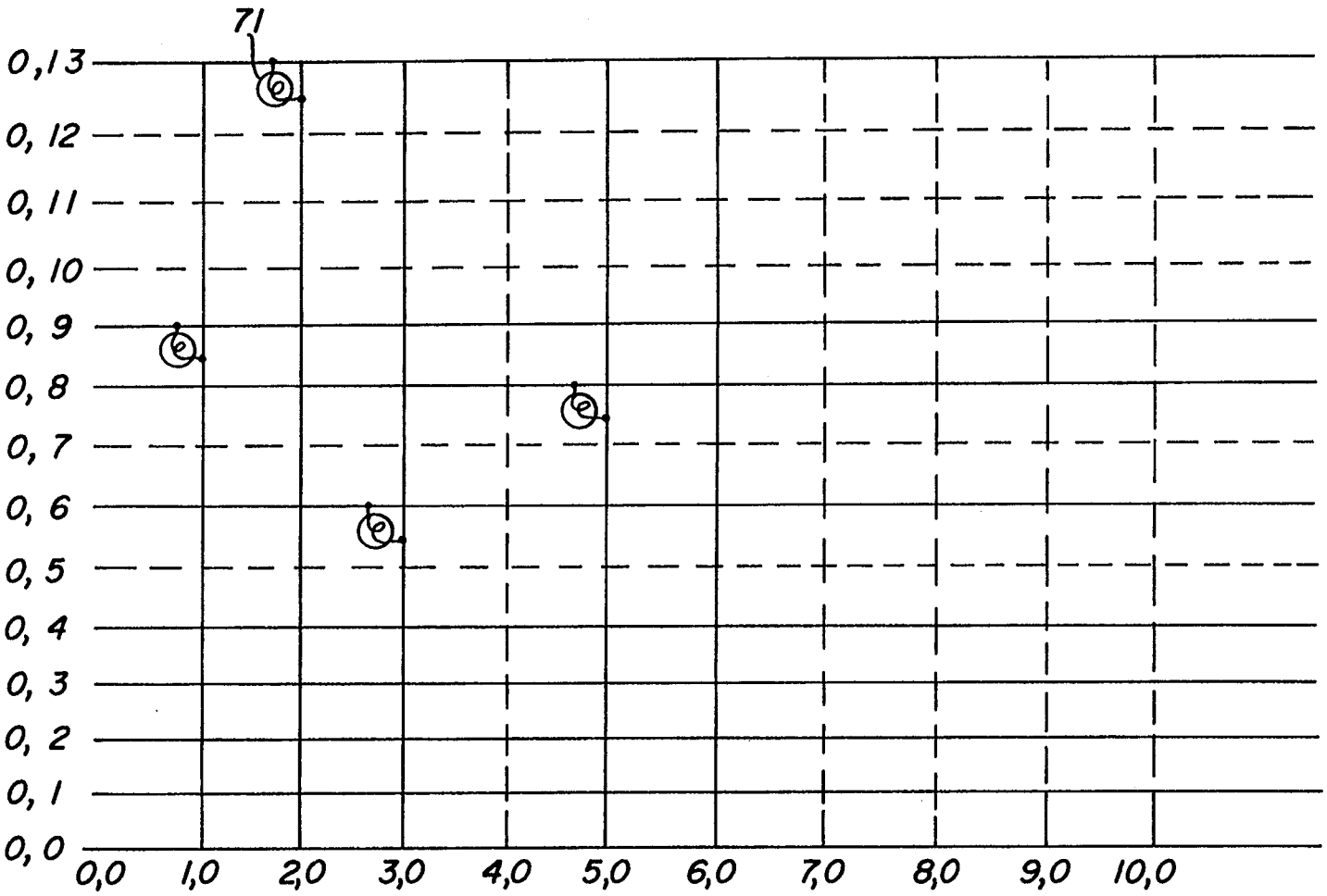
FIG. 7 is a grid arrangement for indicating motion in accordance with the invention.

The received signals also can be applied to the grid board G of FIG. 7. The decoder 65 also can be used to produce an "X" and "Y" output for each sensor. In a ten by ten grid there are 10 horizontal outputs and 10 vertical inputs. Each horizontal output can produce a bias level and each vertical produce a ground. An indicator light at each grid cross position then responds according to the grid position of the sensor. In FIG. 7 there are indicator lights marked 71 through 74 to correspond to illustrative positions of the sensors S-1 through S-4 of FIG. 1. For example, where the sensor S-1 is positioned at "X" coordinate 02 and "Y" coordinate 13, which translates into binary code 0010–0111, the indicator light 71 is illuminated by a ground on line 2,0 and a bias on line 0,13.

It will be understood that there is an indicator light at each cross point, and that when sensor S-1 is moved to a different position, the light corresponding to the new position changes accordingly.

Other aspects of the invention will be apparent to those of ordinary skill in the art, without detracting from the scope of the invention as defined in the appended claims.

What is claimed:

1. Apparatus for detecting motion with respect to at least one sensor position, which comprises means for producing an encoded signal indicative of sensor position having a pre-assigned numerical designation in response to the detection of motion;

means connected to the producing means for transmitting said encoded signal;

means for receiving from the transmitting means said encoded signal, including means for amplifying and converting said encoded signal to an auditory output producing a different tone for each different sensor position, changing in pitch according to a numerical designation of the sensor position.

2. Apparatus as defined in claim 1 wherein said producing means generates infra-red radiation and produces an output signal only when an object moves through said radiation, said transmitting means produces a carrier which is modulated by said signal, and the receiving means demodulates said carrier.

3. Apparatus as defined in claim 2 wherein said signal is encoded and is used to modulate said carrier, and said receiving means recovers said signal.

4. Apparatus as defined in claim 3 wherein said producing means generates a plurality of differently encoded signals and said receiving means responds to a plurality of said differently encoded signals and produces a different output for each of said signals.

5. Apparatus as defined in claim 4 wherein at least one output is sensorially perceptible.

6. Apparatus as defined in claim 5 wherein at least one output is visually perceptible.

7. Apparatus as defined in claim 5 wherein at least one output is auditorily perceptible.

8. Apparatus as defined in claim 1 wherein said producing means generates an outgoing beam and produces said signal when said beam is interrupted; said signal resets said producing means after a prescribed time delay and triggers a code generator within said transmitting means.

9. Apparatus as defined in claim 3 wherein the encoded signal is a set of binary signals that provide a unique designation for said producing means.

10. Apparatus as defined in claim 3 wherein said producing means is positioned in a grid of a hunting area and the encoded signals give the grid coordinates where said producing means is located.

11. Apparatus as defined in claim 9 wherein said binary signals are used to modulate a carrier and the modulated carrier is applied to a transmitting antenna.

12. Apparatus as defined in claim 1 wherein said receiving means includes means for converting said signal to auditory and electrical outputs, an on-off switch connected to the signal converting means, a set of indicator lights connected to an electrical output and an ear phone jack connected to an auditory output to allow a hunter to audibly monitor said producing means; thereby to permit focusing visual attention entirely on an area being monitored.

13. Apparatus as defined in claim 1 wherein the receiving means is tuned to a carrier of said transmitting means, amplified by a first stage, followed by a detector which separates said carrier from the signal by which said carrier is modulated.

14. Apparatus as defined in claim 13 wherein said signal comprises code signals which are decoded and applied to separate outputs on decoder leads and are then applied to a tone generator and to indicator lights.

15. Apparatus as defined in claim 1 for detecting motion and utilizing the detection of the motion, which comprises means for forming a signal in response to the sensing of motion;

means connected to the producing means for transmitting signals produced in response to the sensing of motion; and means for receiving from the transmitting means said record of the signals produced in response to the sensing of motion.

16. Apparatus for detecting motion, which comprises means for producing a signal in response to motion;

means connected to the producing means for transmitting said signal; and means for receiving from the transmitting means said signal;

wherein said producing means generates infra-red radiation and produces an encoded output signal when an object moves through said radiation, said transmitting means produces a carrier which is modulated by said signal, and the receiving means demodulates said carrier and recovers a demodulated output signal;

wherein said receiving means responds to a plurality of differently encoded signals and produces a different output for each of said signals, at least one of which is sensorially perceptible by being auditorily perceptible; and identification of the producing means from which sound emanates is by using a different tone for each different producing means.

* * * * *